United States Patent [19]

Lanier

[11] 4,003,541

[45] Jan. 18, 1977

[54] PORTABLE DECKING FORM

[76] Inventor: John E. Lanier, 495 S. Atlantic Ave., Cocoa Beach, Fla. 32931

[22] Filed: May 20, 1974

[21] Appl. No.: 471,315

[52] U.S. Cl. ..... 249/18; 249/210; 425/62

[51] Int. Cl.[2] ..... E04G 11/38

[58] Field of Search ..... 264/33–34; 425/62; 249/13, 18, 20, 27–28, 207, 210; 52/637–638; 182/182–184

[56] References Cited

UNITED STATES PATENTS

| | | | |
|---|---|---|---|
| 2,671,697 | 3/1954 | North | 425/62 |
| 2,966,718 | 1/1961 | Dave | 249/27 |
| 3,037,259 | 6/1962 | Dave | 264/33 |
| 3,364,647 | 1/1968 | Hubmann | 425/62 |
| 3,445,084 | 5/1969 | Williams | 249/18 |
| 3,625,468 | 12/1971 | Marcott | 249/165 |
| 3,784,151 | 1/1974 | Steele | 249/18 |
| 3,787,020 | 1/1974 | Avery | 249/18 |
| 3,788,494 | 1/1974 | Markewitz et al. | 425/62 |
| 3,826,460 | 7/1974 | Cast | 249/210 |
| 3,902,289 | 9/1975 | Dashew | 52/122 |

*Primary Examiner*—Richard B. Lazarus
*Assistant Examiner*—John McQuade

[57] ABSTRACT

This invention provides a re-usable, unitary, portable, lightweight decking form for the construction of modular housing units having a monolithic slab roof. The portable decking form comprises a relatively flat plate supported by a gridlike network of structural support members, interconnected in a manner so as to form a level upward surface. Connected to the gridlike network are two sets of ground-engaging means: a first ground-engaging support means including rolling means for rendering portable the entire decking form; and a second ground-engaging support means which includes vertically adjustable elevating means which can raise and lower the decking form between a first lower position where the decking form is supported by the first ground-engaging support means and a second raised position where the gridlike network is supported by the second ground-engaging means in a stationary manner. The substantially flat and relatively thin plate further comprises a liquid flow damming means extending between two opposing edges of the plate so as to limit the flow of poured concrete over the upper surface.

18 Claims, 11 Drawing Figures

PORTABLE DECKING FORM

For economic purposes, in both operation and initial construction, many transient residential units, such as motels or hotels, are constructed today on a modular plan wherein each of the various living units, whether a single room or a suite, are all substantially identical. Further, they are preferably constructed of reinforced concrete, a material which is durable, provides useful insulation as to sound and heat and is inexpensive, both for the material itself and, potentially at least, in the method of construction. To further decrease the cost of construction with concrete, it is preferred to form the vertical walls defining the individual residential modules and then to pour a monolithic, massive concrete ceiling extending over a series of such modules, or bays, defined by the vertical walls. The vertical walls serve to support the massive concrete ceiling. The ceiling can be the top roof of the structure or can be an intermediate horizontal level defining the ceiling of a lower level and the floor of a higher level.

Present conventional practice is to form the vertical walls defining the modules or bays and then to construct scaffolding and to place on that scaffolding generally flat mold surfaces which form the ceiling of the bay and, if a multi-story structure is being formed, the floor of the next higher level. Such scaffoldings and mold surfaces are normally made of wood. Due to the relatively high labor cost today and the scarcity of wood, such conventional scaffolding and mold surfaces represent a major expense in concrete construction today, due to the short life of wood construction, in both labor and material costs. There have been attempts to provide support structures for the pouring of the concrete ceiling/floor which are of more or less portable natures and which can be utilized to form such a massive roof. For example, Stout, in U.S. Pat. No. 3,728,838, shows a structure and method for pouring in place a unitary concrete roof. The temporary casting support is level and flat, but requires dismantling after each use before the support structure can be moved to another site. Similarly, Varlonga, U.S. Pat. No. 3,674,232, describes the formation of suspended concrete floors wherein the main support beams for the temporary support structure are also utilized as the permanent support structure for the concrete flooring. Such means also requires dismantling after each use. Also see Sullivan, U.S. Pat. No. 3,630,479, and Comment, U.S. Pat. No. 3,502,296, for further examples of prefabricated concrete pouring forms. Further see Jennings, U.S. Pat. No. 3,409,266.

The use of portable forms which are constructed once and then can be moved from place to place, usually on a supporting wheel carriage, have also been suggested for use in construction. These have generally not found success in the industry for various reasons, including their bulkiness, weight, great expense, or other design failures to provide for all of the requirements to be met in the construction of particular buildings. For example, U.S. Pat. Nos. 3,037,259 and 2,966,718, both to Dave, describe various types of decking forms for the pouring of a monolithic concrete ceiling which is supported by a plurality of columns regularly spaced beneath the flooring. The forms used by Dave are preferably plywood and are supported upon a wheeled vehicle. Dave further requires the use of intermediate removable elements between adjoining plywood forms in order to form a continuous support structure. Also see Kohlhaas, U.S. Pat. No. 2,377,944. Another concrete pouring form for forming a modular concrete ceiling, level or arched, which can be carried and moved about on a carriage, but which must be detached from the carriage when in use, is shown by Metrailer, U.S. Pat. No. 3,744,945.

A completely portable unit on a wheeled carriage has been described as being useful for forming a continuous intermediate floor or uppermost ceiling in a structure having a modular design with intermediate vertical walls for supporting the ceiling, as shown by Haws, U.S. Pat. No. 3,659,977. The Haws device is also useful for forming the vertical walls. There is no provision for the utilization of two adjoining units by Haws for forming a continuous ceiling over a series of modular units, nor is there provision for forming a ceiling which extends beyond the vertical supporting walls. The mold surfaces of Haws are further extremely heavy, thick structures, which are rigid and intended to support the entire weight of the concrete being poured.

A variety of units for forming a massive hyperbolic or parabolic ceiling constructions is shown, for example, in the U.S. patents to Short, U.S. Pat. No. 3,234,620, and to Wilkins, U.S. Pat. No. 3,320,649.

The construction industry, however, remains in need of a successful means for quickly and efficiently pouring a massive monolithic concrete roof, or suspended floor, for a modular type of building, where the support structure for the mold is relatively lightweight, can be quickly and easily transported into position and then quickly and readily moved, once the concrete structure has set, to the next position, and can be reused almost indefinitely. Such a structure, in addition to being quickly transportable, must provide the necessary support to form a flat and level structure and must provide the necessary continuity to form the monolithic roof, when a plurality of the different units must be utilized to form a massive unitary roof for a large number of modular units simultaneously.

In accordance with the present invention, there is provided a unitary, portable, lightweight decking form having a continuous surface for the support of a monolithic slab of poured concrete during setting thereof, designed and adapted for use in conjunction with a plurality of other like units for the formation of a monolithic roof structure for a plurality of modular building units separated by vertical support walls, the unitary portable decking form comprising:

1. A gridlike network of interconnecting structural support members, the top surfaces of all the support members being substantially level and coplanar;

2. first ground-engaging support means for the gridlike network and operatively connected thereto, the first ground-engaging support means comprising rolling means rotatably connected to the bottom portion thereof and designed and adapted to permit rolling said portable decking form over a horizontal surface;

3. second ground-engaging support means for the gridlike network and operatively connected thereto, the ground-engaging support means comprising vertically adjustable elevating means secured to the bottom portion thereof and designed and adapted to raise and lower the support network from a first lower position where the gridlike network is supported by the first ground-engaging support means, in which position the decking form can be rolled, to a second, raised position, where the gridlike network is supported by the second ground-engaging means in a stationary manner;

4. a substantially flat, relatively thin plate, resting upon and supported by the upper surfaces of the gridlike network, providing a relatively flat and level upper surface for supporting wet concrete to form a flat-roof; and 5. liquid flow damming means attached to and extending upwardly from the upper surface of the level plate, extending between opposite sides of the plate and designed and adapted to prevent the flow of poured concrete onto that portion of the flat surface between the damming means and the nearest nonintersecting edge of said plate.

Preferably, the support network is formed of interconnecting beams, preferably I-beams, but also including boxgirders or box-beams, or channel beams, interconnected in such manner that the upper surfaces of the flanges form a coplanar surface for the support of the flat plate.

In a further preferred embodiment, that portion of the flat plate, and the gridlike support network thereunder, adjacent the damming means, has a greater dimension than the major portion of the plate, whereby adjacent decking forms, separated by a vertical wall can form a continuous overhang beyond the vertical dividing walls. Thus, for example, the upper surface of the flat plate has an L-shaped configuration.

As a further preferred aspect of the present invention, the decking form also is provided with linking means on the gridlike support network for balanced connection to lifting means, such as a crane or derrick, or light weight winch for rapidly lifting and moving the portable decking form to different levels of a building under construction and the flat plate is provided with means for exposing such linking means when desired.

In yet another preferred embodiment of the present invention, that portion of the flat plate forming the overhang beyond the vertical walls also comprises a convex portion, extending between opposite sides of the flat plate substantially parallel to the liquid damming means and being designed and adapted to provide a depression in the underside of the poured and set concrete roof. Such depression provides a so-called drip-run in the roof overhang to prevent flow of water to the vertical exterior wall of the building along the underside of the overhang.

It is also contemplated, in the optimum embodiment of the present invention, that the portion of the flat plate between the damming means and the nearest nonintersecting side be of sufficient space to provide a work space for personnel, and that there be provided rail means, secured to the decking form, adjacent said nonintersecting edge and extending upwardly therefrom, to provide a safe working area in accordance with statutory laws.

In accordance with this invention, a series of vertical walls are constructed, of concrete or other massive construction, defining adjoining modular or row-type units and designed and adapted to support a monolithic flat roof or intermediate ceiling/floor level. A plurality of the portable decking forms, in accordance with the present invention, are wheeled in place, such that the wider portion of the decking form, i.e. the portion adjacent the damming means, extends beyond and around the end of the vertical walls, and preferably so that the narrower portion of the surface is juxtaposed against and preferably substantially level with the top surface of the vertical walls; the wider portion of the flat plate of each of the plurality of decking forms is abutted against the opposite side of the wider portion of the adjacent flat plate such that the portions of the plates which extend beyond the vertical walls form a substantially continuous, uninterrupted surface, extending beyond the vertical walls. Thus a monolithic, unitary concrete ceiling structure can be poured, including an overhanging portion extending beyond what will become the interiors of the modular units. Further, that portion of the flat plate, between the liquid flow damming means and the nearest nonintersecting edge provides a surface upon which workmen can stand during or before the pouring of the concrete to carry out any necessary duties incident thereto.

For the purpose of illustrating the invention, and for presenting exemplary embodiments thereof, the attached drawings are presented. The drawings do not represent the full scope of the invention and the invention should not be limited to the precise arrangements shown therein. These arrangements being merely exemplary of the full scope of the invention.

Figure 4:
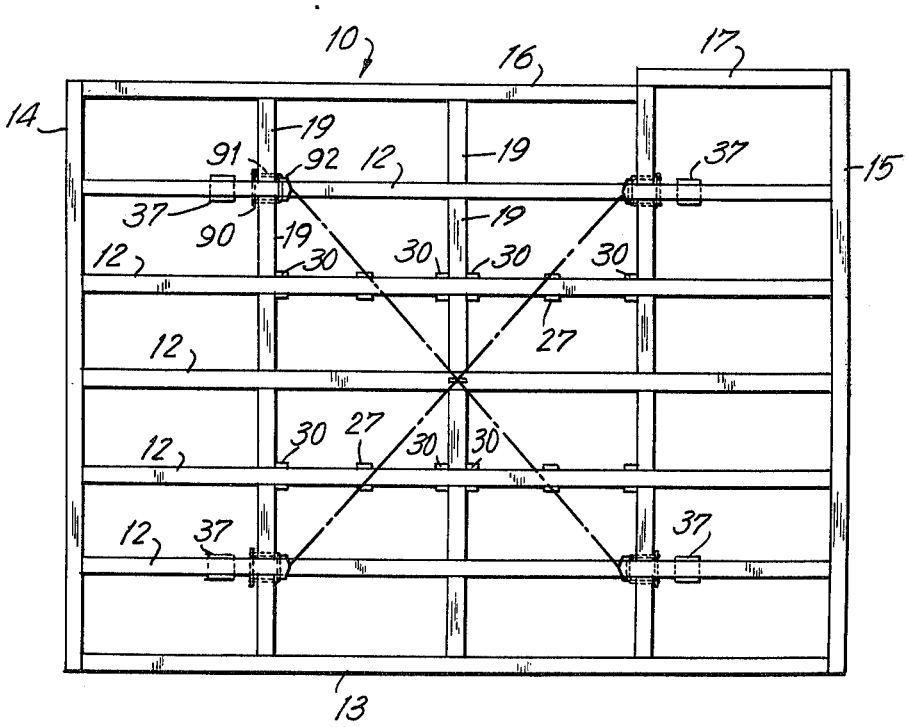
FIG. 4 is a plan view of the gridlike support network of the present apparatus.
Figure 5:
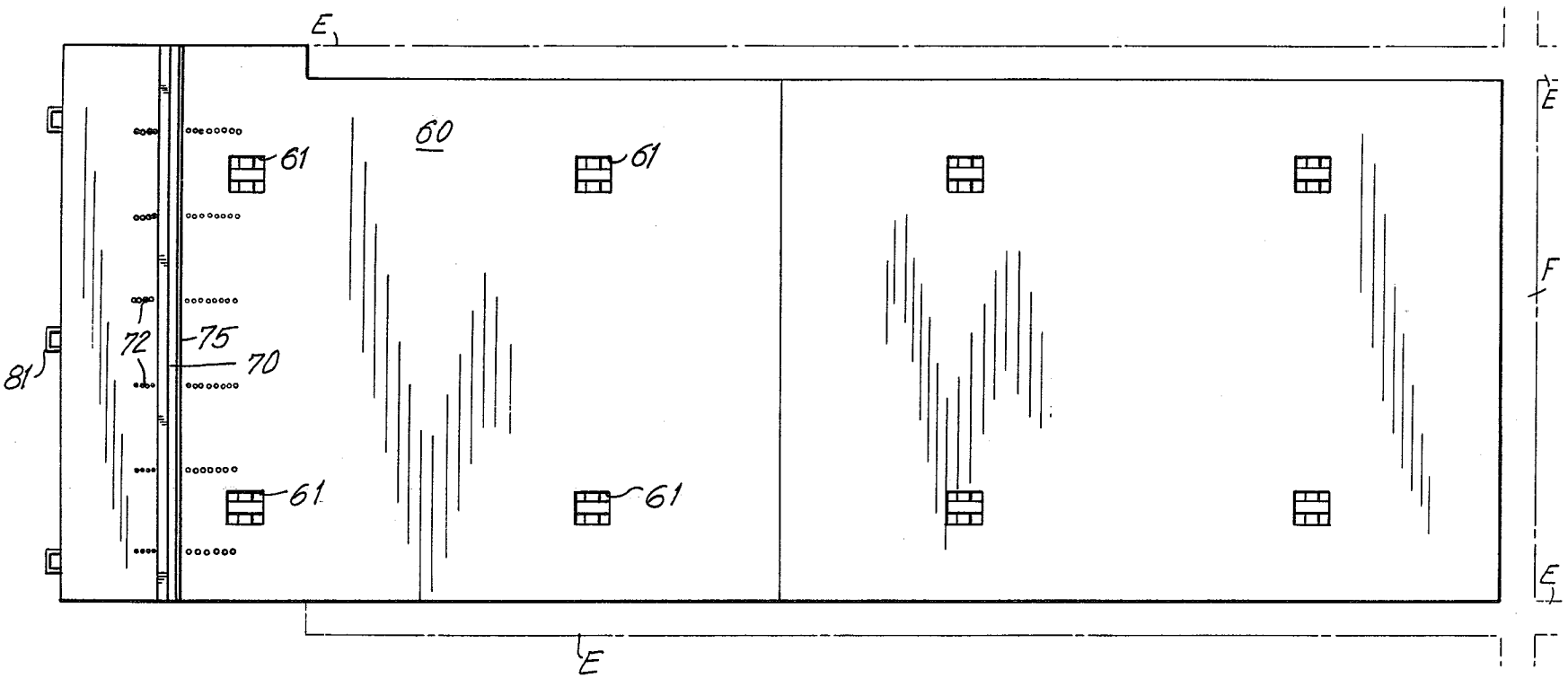
FIG. 5 is an enlarged view of one of the modular units of FIG. 3.

Referring to the drawings, particularly FIG. 4, the portable decking form of the present invention, comprises a gridlike network of interconnecting beams (in the drawings exemplified by I-beam), the network being generally indicated by the numeral 10. The network 10 comprises longitudinal central beams 12 extending the entire length of the network, longitudinal side beam 13 along the long side of the generally L-shaped grid network, lateral side beams 14 and 15 and longitudinal side beam 16 forming the portion of the fourth side of a network, and short beam 17 forming the outside edge of the short leg of the L. The longitudinal beams 12, 13, 16 and 17, are joined by short lateral beams 19, which can be joined, for example, by welding or by the use of riveted or bolted flanges.

Figure 2:
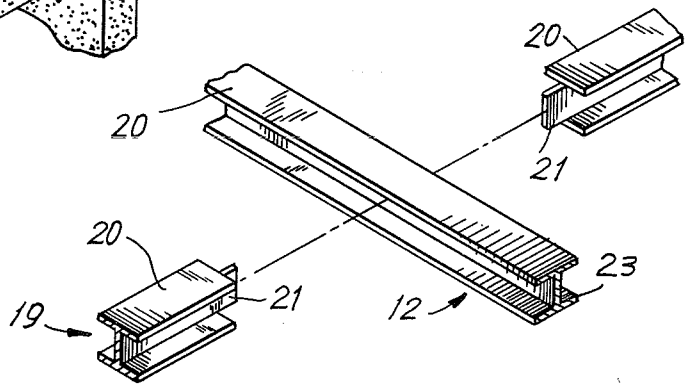
FIG. 2 is an exploded perspective view showing a method for joining the intersecting beams forming the gridlike support network of the apparatus of this invention.

As shown in FIG. 2, the cross members, i.e. longitudinal beam 12 and cross beams 19, join so that the upper flanges 20 of all of the beams form a substantially flat level surface. This is obtained by cutting away a portion of the flange from above and below the web 21 of the lateral cross-beams 19 and fitting the exposed portion of the web 21 between the overhanging portions of the flanges 20 on the longitudinal beams 12; preferably, the exposed portion of the web 21 on each lateral beam 19 is sufficiently long to extend into and contact the web 23 in the longitudinal beam 12 and to permit contact between the flanges 20 of each lateral beam 19 and the longitudinal beam 12. Various edge beams, 13, 14, 15, 16 and 17, also join with a perpendicular beam in the same manner. As shown, the web of beam 13 extends under the flanges of lateral beams 14 and 15 as do the webs of beams 16 and 17.

Alternatively, the I-beams can be replaced by, for example, box girder beams or channel beams. In that case, one pair of parallel surfaces, the upper and lower, are cut away, and the vertical, or side, surfaces, mate in the same manner as the single webs 20, in the I-beams shown in FIG. 2.

Figure 11:
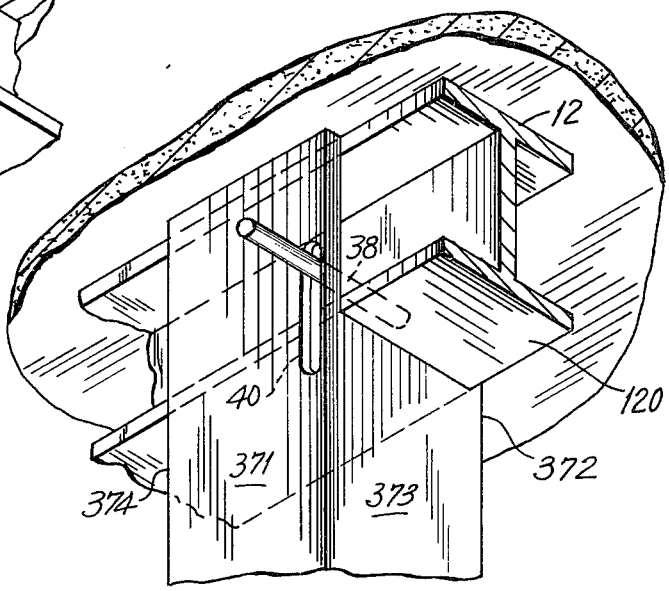
FIG. 11 is an enlarged partial view in perspective of the swivel connecting means for a second ground-engaging support member, in its ground engaging position of FIG. 6.

The gridlike network 10 is, or can be, supported by two alternative ground engaging support means. Extending downwardly from the gridlike network 10 are two pairs of wheeled struts, each indicated generally by the numeral 26, or wheeled columns 26, each comprising a vertical girder 27, secured to an I-beam of the network 10 at its upper end, and a wheel 29 at its lower end. The vertical girder is further supported by transverse beams 30 extending diagonally from the vertical girder 27 to the gridlike network 10. The second ground-engaging support means comprises four vertically adjustable leg members, each generally indicated by the numeral 36; the vertically adjustable leg members 36 each comprise a vertically oriented hollow box girder 37, rotatably connected via pin 38, at its upper end, to the support network 10 and jacking, or elevating, means, generally indicated by the numeral 39 at its lower portion. The pin 38 is rigidly connected to a beam 12 on the gridlike network 10 and extends through a vertically elongated slot 40, formed through two opposing sides 371 and 372 of the box beam 37. As shown in FIG. 11, the transverse sides 373 and 374 are cut out at the top so as to permit the engagement of the opposing sides 371 and 372 around, and substantially along the entire height, of the I-beam 12 when the girder is supporting the decking form. The elongated slot permits the swiveling, or rotation, of the ground-engaging means 37 without interference by the bottom flange 120 of the beam 12, to which it is connected, during a sufficient angle of rotation to raise the bottom of the ground-engaging means 36 sufficiently above the ground to prevent interference when rolling the system on the wheeled support means 26.

Telescopically interfitted within the lower end of the hollow box-beam 37 is a telescopic extension member, or foot, 41, extending adjustably within, preferably in sliding contact, one with the other, and projecting from the lower end thereof.

The hollow interior of box beam 37 and the outer surface of the foot 41 are of similar, preferably polygonal, cross-sectional configuration; it is preferred that the two members cannot rotate along their longitudinal axis, relative to each other. The rectangular cross-section members are shown each having two pairs of parallel sides. One or both pairs of faces of the outer telescoping member are provided with one or more oppositely disposed, vertically aligned, apertures 421, intended to receive a fixing means, here shown as a suitable locking pin or bolt 42.

The inner member, in this case the foot 41, has four outer sides 411, 412, 413 and 414, each preferably in sliding contact with the interior of its respective confronting side in the outer member, i.e. sides 371, 372, 373 and 374, respectively. At least one pair of parallel faces in the inner foot 41 has a plurality of oppositely disposed, vertically aligned, apertures, designed and adapted to align with the apertures in the confronting sides in the outer member, e.g. sides 371 and 372. This permits selectively fixing the inner member within the outer member, at a desired relative telescoping length. The spacing between the apertures 43, must provide a sufficient thickness of material to support the full weight of the decking form, including the poured concrete, when the bolts 42 are in place. In order to decrease the length of these increments, and thus to improve the adjustability of the telescoping foot, the apertures in the two pairs of transverse sides, i.e. sides 411 and 412 and 413 and 414, respectively, are staggered, so that the incremental difference between the successive apertures is halved.

Advantageously, the bottom of extension foot 41 comprises a flat plate 50, extending perpendicularly beyond the foot 41 and having secured thereto, advantageously, for example, a hydraulic jacking means 54. Secured to the bottom of the box beam 37, and projecting perpendicularly therefrom, in alignment with plate 50, is a plate 56 secured to the movable member of the jack 54.

The substantially flat, relatively thin plate 60, rests upon and is supported by the gridlike network 10. The plate has substantially the same plan view, i.e. a short L-shaped leg, as does the network 10, as shown in FIG. 4.

Advantageously, the flat plate 60 provides 4 openings therethrough which can be covered by removable members 61 which, when in place, rest substantially flush with the upper surface of the plate, giving the appearance of a continuous flat surface.

Most advantageously, liquid damming means are provided, along the L-shaped portion of the flat plate parallel to the outer edge of the form, defined by beam 15; in this case the damming means are provided by the channel beam 70. The location of the channel beam 70 along the flat plate 60 can be varied; in this example, the channel beam 70 can be fixed in place at the various threaded openings 72 through the surface of the top plate 60, utilizing a threaded bolt member 71.

Further, there is most advantageously provided, a substantially semi-circular convex rod member 75, attached to the upper surface of the flat plate 60, adjacent the channel beam 70. The semi-circular rod 75 extends substantially parallel to the channel beam 70 and coextensive therewith.

There is further provided along the outer edge of the plate 60, connected to the outer edge I-beam 15, rail means, generally indicated by the numeral 80. In this example, the rail means comprise channel bases 81 secured to the I-beam 15; vertical arms 82, slidably connected at one end of each arm 82 into the respective channel base 81; and rail means 83 extending perpendicularly to the arms 82 and bolted thereto. As shown, the damming means and the rail means are substantially parallel and extend the full length of the L-portion of the plate 60.

It is contemplated that a plurality of such decking forms be utilized in the construction of a single monolithic roof. The decking forms are connected laterally, at the outside of the L-shaped portions, i.e. at I-beams 13 and 17, and longitudinally, along the lateral edge I-beam 14. The connections can be made, for example, merely by placing the decking forms in abutment, but preferably include bolting means, via bolts 90, extending through the webs of the I-beams 14 and 17 and 13, for example, for longitudinal and lateral engagement, respectively.

Figure 3:
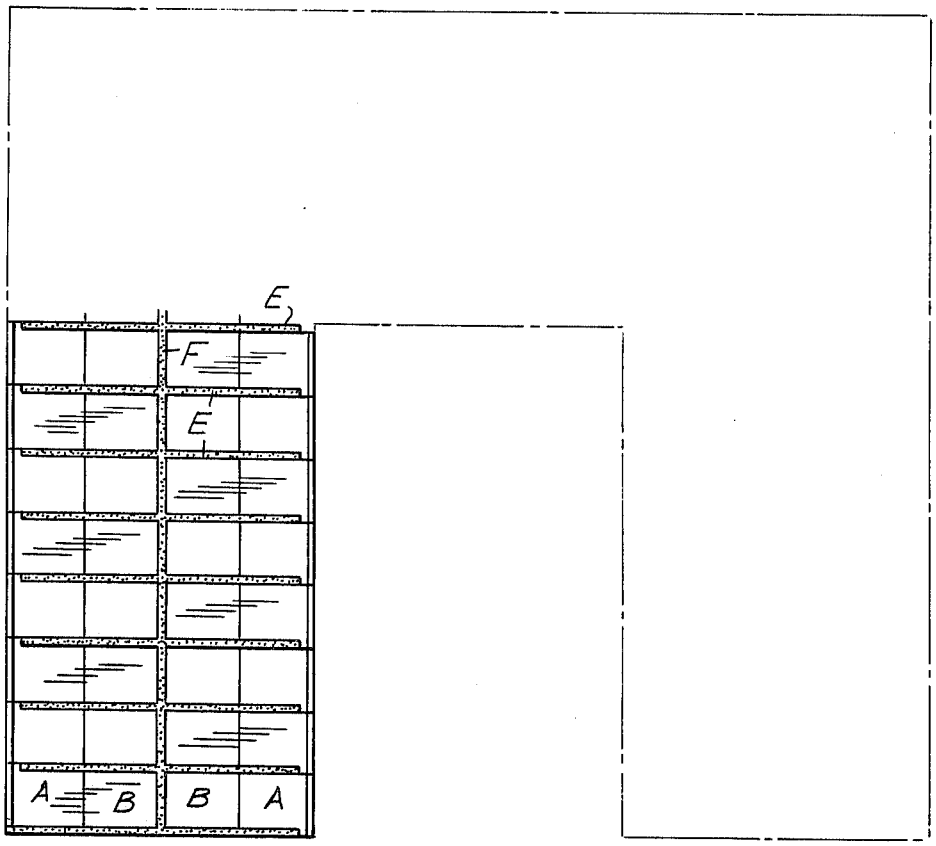
FIG. 3 is a plan view of a construction site showing the use of a plurality of apparatus in accordance with the present invention.

As shown in FIG. 3, when each modular unit has a greater depth than the length of a single decking form, a second decking form, Type B, can be utilized. The second decking form is placed in the rear of the unit and, as shown, is of a substantially rectangular shape, without the short leg of the L being required. For a modular unit of a different plan design; the design, including size, of the decking forms may be changed accordingly. The gridlike network and the two sets of ground-engaging means are substantially the same design, as explained above.

Figure 10:
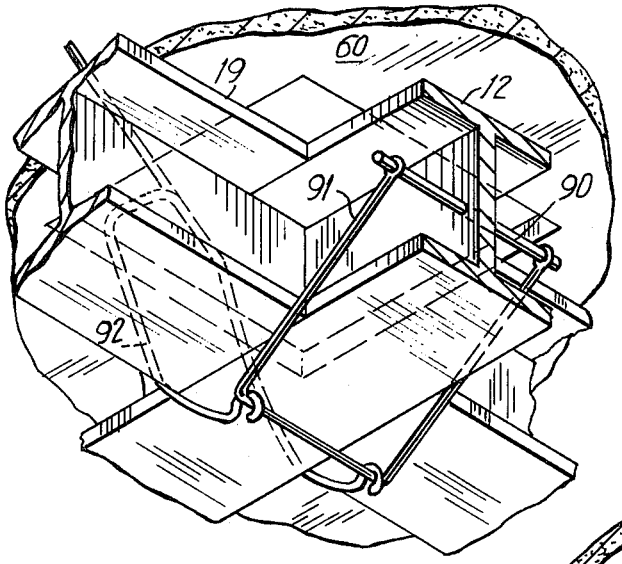
FIG. 10 is a partial perspective view showing an intersection of the beams forming the support network and an example of a linking means for holding the structure in the position shown in FIG. 8.

Each of the decking forms, whether of the type A or B, as shown in FIG. 3, also includes means for providing lifting, as by a crane or light weight winch, to a higher level of work. For example, once a poured concrete roof ceiling has set, the decking form can be moved up to the next level and placed atop that previously set monolithic roof (see FIG. 8). Linking means are provided on the gridlike network to support the decking form in a stable and generally level manner during such lifting operation. One advantageous system is shown, for example, in FIG. 10, and can be accessible through the removable portions 61 of the relatively flat upper plate 60.

Figure 8:
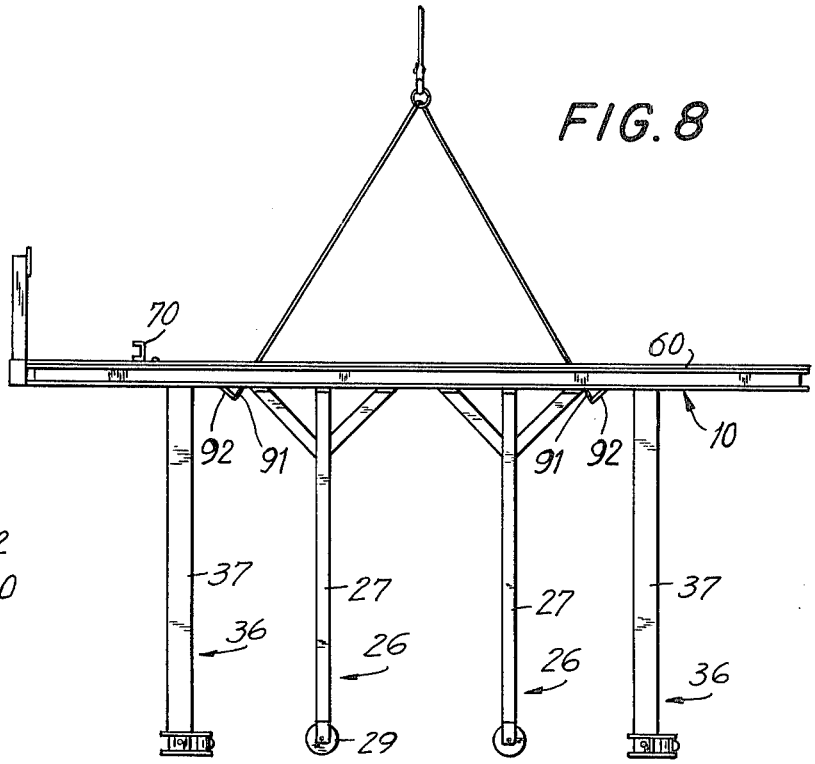
FIG. 8 is a side elevation view showing the portable platform of the present invention being hoisted to a new position.

The system comprises a pin 90 secured to a longitudinal central I-beam 12 of the gridlike network 10 and a generally U-shaped hanger 91 suspended therefrom and rotatably connected thereto. The pin 90 is connected to the beam 12 adjacent an intersection with a lateral I-beam 19. Rotatably connected to the U-shaped member 91 is an inverted U-shaped member 92, connected to the horizontal connecting bar of the U-shaped member 91; the inverted U-member 92 extends around and upwardly along that portion of the longitudinal beam 12 on the opposite side of the lateral beam 19. The two U-shaped members 91 and 92 thus form a craddle surrounding the intersection of the I-beam, with the base portion of the inverted U-shaped member 92, resting on the upper flange surface 20 of I-beam 12 on one side of the intersection with lateral beams 19 and the base or cross-member of U-shaped member 91 extending below the bottom surface of the I-beam 12. Preferably, four of these are located equidistantly around the center of the decking form to provide a highly stable means by which the decking form can be readily lifted by conventional crane or derrick means, as shown in FIGS. 4 and 8.

In operation, the decking forms of the present invention can be utilized in the construction of a modular type housing unit, e.g. a commercial motel unit, by the following method: the floor of the modular unit (for example having the general U-shape of FIG. 3) is poured and the vertical walls dividing the modular units (indicated by the letters E and F) are constructed. Because of the depth of each of the modular units defined by the walls E and F, it is necessary to utilize two decking forms, one of the L-shape, type A, as shown in FIG. 4, and the other of a rectangular type. These are indicated as A and B, respectively, in FIG. 3. The type B decking form is wheeled into place, utilizing the wheeled ground-engaging means 26; when the device is being wheeled, the second ground-engaging means 36 are in the raised position as indicated by the phantom lines in FIG. 6.

Figure 6:
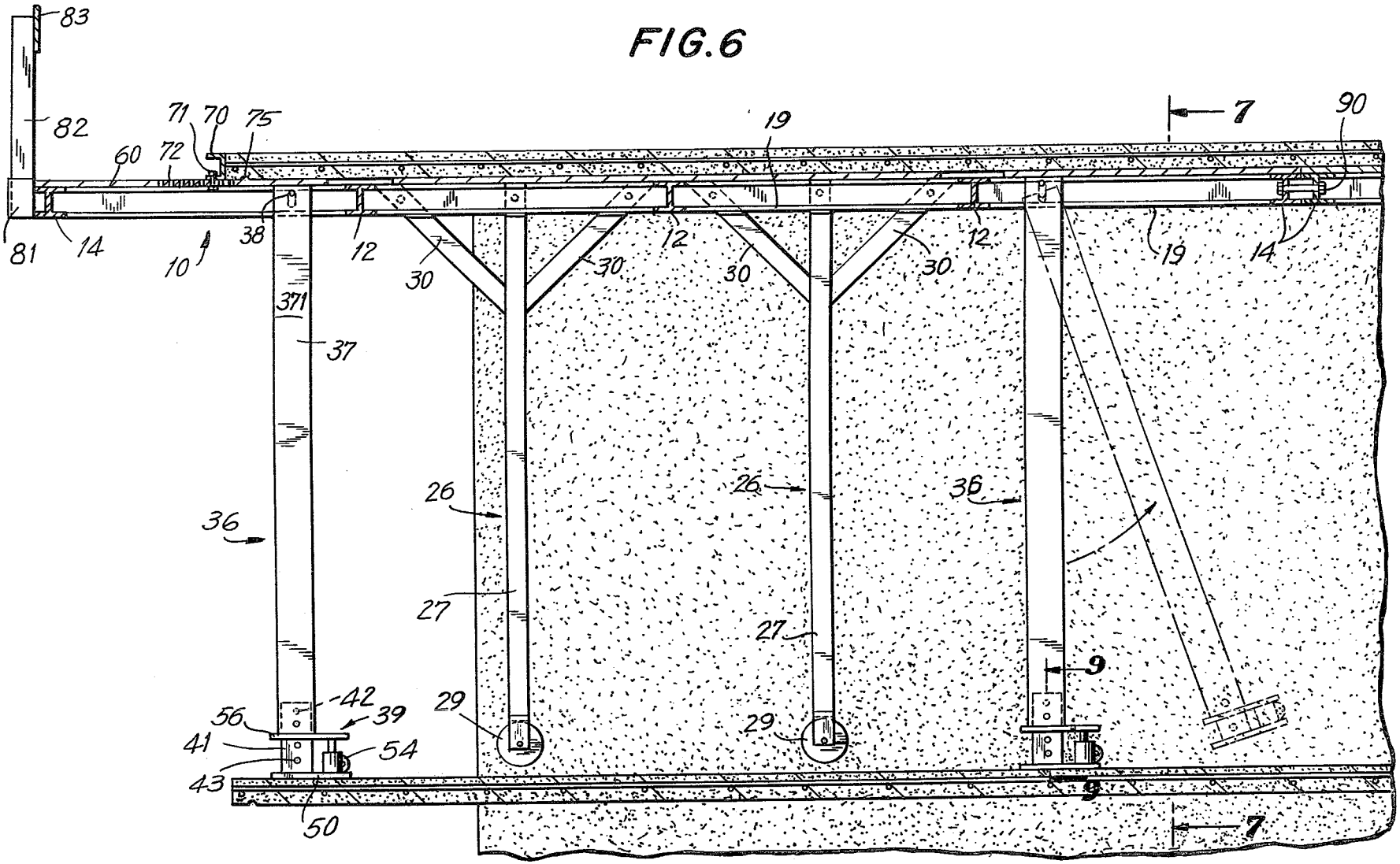
FIG. 6 is a side elevation view of a portable decking form in accordance with the present invention.
Figure 7:
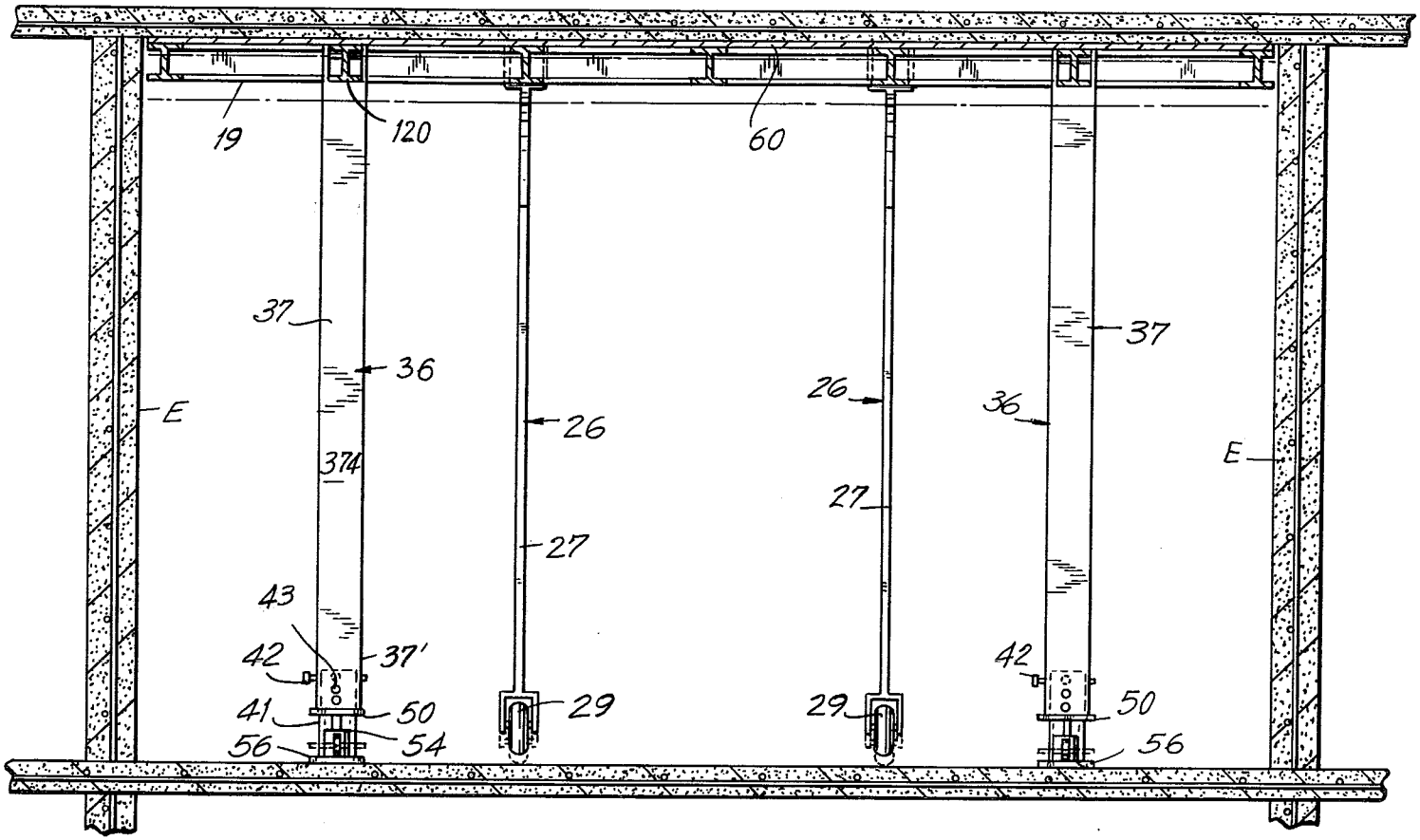
FIG. 7 is a cross-sectional view along lines 7–7 of FIG. 6.
Figure 9:
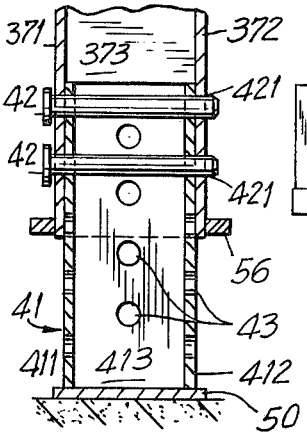
FIG. 9 is an enlarged cross sectional view along lines 9–9 of FIG. 6.

Once the decking form is in place, the second ground-engaging means 36 are lowered to the positions shown by the solid lines in FIGS. 6 and 7 so that the bottom plate 50 of each of the means 36 are in contact with the ground. Hydraulic jack means 54 on each of the beams 37 are then actuated so as to raise the plate 56 and thus beam 37 and, in turn, the gridlike network 10 until the wheeled members 29 are completely off the ground and the upper surface of the relatively flat plate 60 is in the desired relationship with the upper surfaces of the walls E and F. In this position, as shown in FIG. 11, the bottom flanges 20 of two I-beams 12, rest on the cut-out sides 373 of the girders 37.

Figure 1:
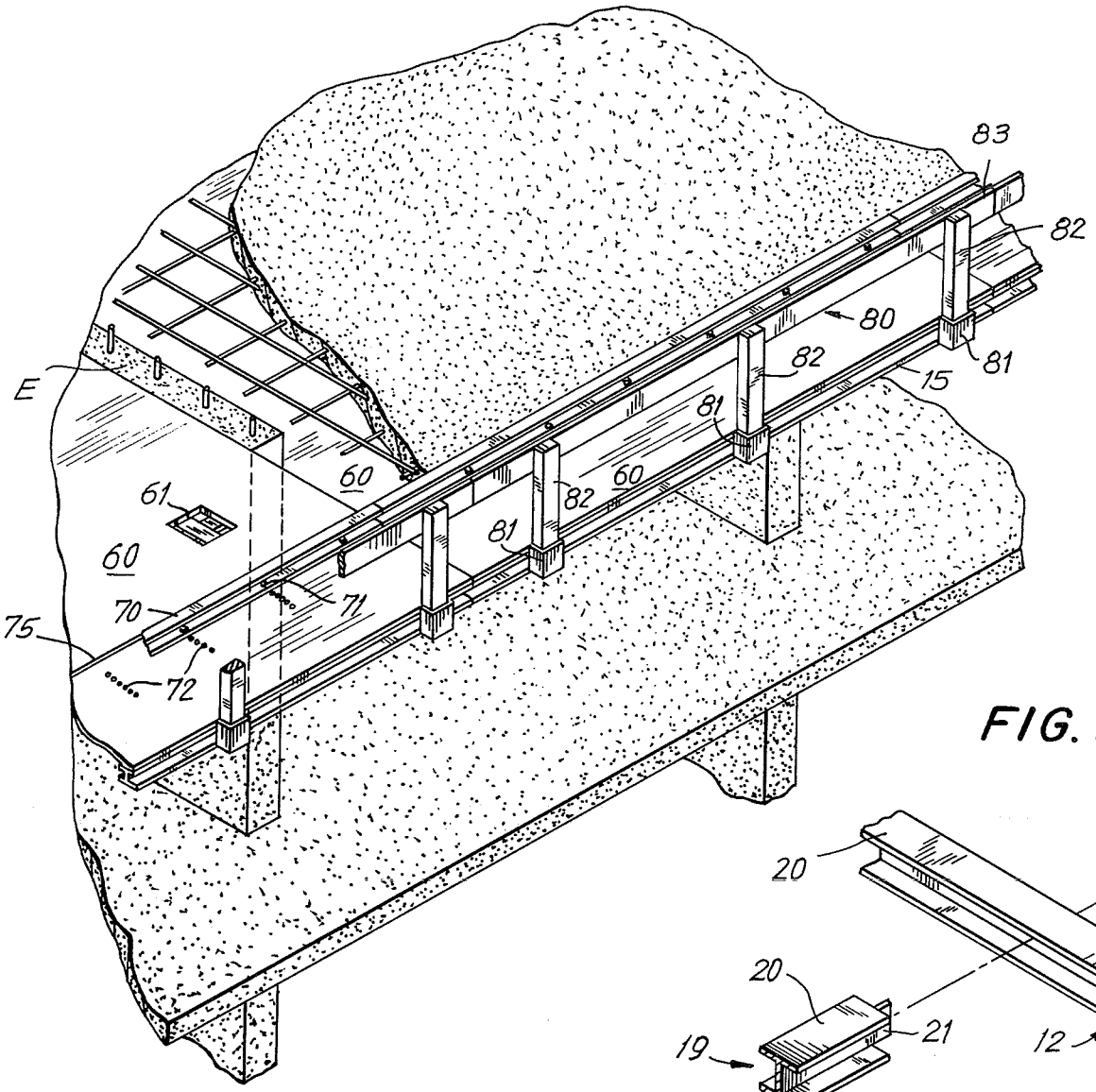
FIG. 1 is a partial perspective view, showing portion of a plurality of the decking forms of the present invention in place and in use for the pouring of reinforced concrete roof for a modular row-type structure.

Generally it is preferred that the top surface of plate 60 be substantially flush with the tops of the walls E and F, as shown in FIG. 1. However, as desired, this relationship can be varied in accordance with conventional architectural principles. Pins 42 are then inserted through slots 43 and 421 so as to secure the decking form at the desired height without relying upon the hydraulic jack means to maintain the level of the decking form, especially after concrete has been poured.

Once the interior decking forms B are in place, the outer forms A are wheeled into place. The forms A and B are so dimensioned that the short leg of the L of forms A extend around the outer edge of the walls E and contact the form A in the adjoining modular unit. The length of the short leg of the L is therefore substantially equal to the thickness of the wall E. That portion of the decking form A extending beyond the wall E can be used to provide an over-hanging roof beyond the outer facade wall of the module, and thus provide, for example, an external corridor connecting the various rooms or modular units.

The extent of the over-hanging portion can be limited by the fluid damming means 70; the channel 70 can be placed in different positions relative to the end of wall E and the outer end of the form A, i.e. where the safety guard rail 80 is located. For example, channel beam 70 can be located so as to provide substantially zero overhang beyond the wall E by merely placing the channel beam in position at the end of wall E. The space on the substantially flat plate 60, between the channel beam 70 and the safety rail 80, provides a working surface for workmen at the site before, during and after the pouring of concrete.

The decking form A is then also raised by its second ground-engaging means 36 in the same manner as was the form B, as explained above. In the example shown in FIG. 1, the channel beam 70 is so placed as to provide a substantial overhang beyond the ends of walls E.

Advantageously, a network of reinforcing material, for example, sucker-rods, as shown in FIG. 1, can be placed on the flat plate 60, and these reinforcing means can extend over the entire modular structure, i.e. the various forms A and B as shown in FIG. 3. As explained above, the surfaces of all of the plates 60 of all of the decking forms indicated in the drawing of FIG. 3, are substantially at the same level and flush with each other.

After the concrete has been poured over the reinforcing member network, and permitted to harden and set, the decking form can be removed therefrom and used elsewhere. In this case, the pins 42 are removed and jacking means 54 activated to lower the decking form onto its wheeled ground-engaging members 26. The jacking means is used to lift the horizontal plate 50 completely off the ground, in which position the beam 37 hangs downwardly from the pin 38, and the upper end of slot 40, so as to permit swiveling of the ground-engaging means 36 to the position indicated by the phantom lines in FIG. 6. The slot 38 at the upper end of the beam 37 thus permits the swiveling of the means 36 without interference from the flanges 20 of the I-beam 12 of the gridlike network 10. When the beam 37 is used as a support for the gridlike network, the pin 35 rests at the bottom edge and is supported by the bottom edge of slot 40.

The decking form can then be rolled out from under the hardened and set new concrete roof; the plates 61 are removed from the upper surface and a derrick or crane lifting means connected to the lifting handles 92 and the entire decking form lifted as a unit to the next level, as shown in FIG. 1, resting upon the previously poured and cast-in-place roof. The previous procedures are repeated to obtain the next level ceiling, as desired.

The lightweight construction of the portable decking form of the present invention renders it extremely easily wheeled around a construction site by two men. Indeed, it can be readily lifted over low obstructions, manually, by several men. For example, the total weight of a decking form of a common size, made substantially completely of aluminum, including the flat plate 60 (wherein the wheeled ground-engaging means 26 are about 8 ft. long and the flat plate 60, and the supporting frame 10, are about 12 ft. by 16 ft.) is only about 470 lbs.

Although the decking form of the present invention can be suitably made of substantially any usual construction material, i.e. metal, in order to obtain the greatest advantage from this decking form, lightweight metal, especially aluminum, is preferably utilized in forming the gridlike network and the ground-engaging support means. Accordingly, all of the I-beams and girders forming the network and the vertical support members are preferably formed of aluminum and the support plates 50 and 56 on the second ground-engaging means are preferably welded by conventional means to the aluminum vertical members. The relatively thin, substantially flat plate 60 is also preferably formed of aluminum. Further, the upper surface of the flat plate 60 is preferably coated with an anti-sticking material to prevent any adherence between the poured concrete and the plate. Such materials include, for example, semi-permanent coatings of solid polymers of fluorinated ethylene, e.g. Teflon, or silicones or liquid lubricants, such as inexpensive water and petroleum oil mixtures or silicones.

I claim:

1. A unitary portable decking form having a continuous upper surface for the support of a monolithic slab of poured concrete during setting thereof, for use in conjunction with a plurality of other like units for the formation of a monolithic roof structure for a plurality of modular building units separated by vertical support walls, the unitary portable decking form comprising:

A. a gridlike network of interconnecting structural support members, the top surfaces of all the support members being substantially level and coplanar;

B. first ground-engaging support means for the gridlike network and operatively connected thereto, the first ground-engaging support means comprising movable means connected to the bottom portion thereof to permit movement of the portable decking form over a horizontal surface;

C. second ground-engaging support means for the gridlike network and operatively connected thereto, the second ground-engaging support means comprising vertically adjustable elevating means secured to the bottom portion thereof and serving to raise and lower the support network between a first lower position, wherein the gridlike network is supported by the first ground-engaging support means and in which the decking form can be moved, and a second, raised position, wherein the gridlike network is supported by the second ground-engaging means in a stationary manner and the first support means is lifted from the support surface, said second ground-engaging support means further comprising a vertically extending girder movably connected at its upper portion to the gridlike network so as to permit moving the second ground-engaging support means out of contact with the ground, when the decking means is supported by the first ground-engaging means, the vertical girder of the second ground-engaging support means being a substantially hollow member, and the vertically adjustable elevating means comprising a hollow lower member telescopically interfitted, and relatively slidable, with the lower portion of the girder, and a jacking means having a base and a movable column means extending therefrom, the base being connected to one of the girder and the hollow lower member and the column means being connected to the other; and D. a substantially flat, thin plate resting upon and supported by the upper surfaces of the gridlike network and providing a continuous, flat and level, upper surface for supporting wet concrete.

2. The portable decking form of claim 1, wherein said movable means of the first ground-engaging support means are rolling means.

3. The portable decking form of claim 1, wherein said vertically extending girder is rotatably connected at its upper portion to the gridlike network.

4. The portable decking for of claim 1 wherein the lower member of said adjustable elevating means has a similar cross sectional configuration to the lower portion of the vertical girder.

5. The portable decking form of claim 1 wherein liquid flow damming means is attached to and extends upwardly from the upper surface of said plate, said damming means extending between opposite sides of said plate to limit the flow of poured concrete over the upper surface thereof.

6. The decking form of claim 1, wherein the gridlike network is formed of perpendicularly interconnecting lateral I-beams and longitudinal I-beams, the flanges of the lateral I-beams being removed from the end portions abutting against the side of a longitudinal beam, such that the ends of the web of the lateral beams are in contact with the webs of the longitudinal beams and the flanges of the lateral and longitudinal beams are in contact and substantially coplanar.

7. The portable decking form of claim 5, wherein the substantially flat, relatively thin plate has an upper surface having a generally L-shaped plan configuration.

8. The decking form of claim 7, wherein the damming means extends over that portion of the upper surface including the short leg of the L.

9. The portable decking form of claim 7, comprising in addition safety rail means secured to the edge of the gridlike network including the short leg of the L, extending perpendicularly upwardly therefrom.

10. The portable decking form of claim 9, comprising in addition adjusting means for adjusting the position of the damming means relative to the safety rail means.

11. The portable decking form of claim 1, wherein the first ground-engaging support means comprises a vertically elongated girder connected at its upper end to the gridlike network and having wheel means rotatably connected at its lower end, there being provided a plurality of such first support means to independently support and permit movement of the decking form.

12. The portable decking form of claim 1, wherein the vertically adjustable elevating means secured to each of the second ground-engaging support means are independently adjustable so as to permit maintaining the substantially flat plate horizontally level to overcome any unevenness or inclination of the supporting surface.

13. The portable decking form of claim 1, wherein the telescopically interfitted members each have a substantially rectangular cross-section, and wherein opposing faces of both the inner and the outer telescoping members have apertures therethrough which are aligned with one another and comprising in addition a fastening element inserted through and retained in the apertures in the inner and the outer telescoping members, thereby serving to fix the vertically adjustable elevating means into a desired vertical position.

14. The portable decking form of claim 1 comprising in addition means for connecting a plurality of decking forms together, in a manner such that the substantially flat upper surfaces are substantially co-planar and level.

15. The portable decking form of claim 1 comprising in addition a plurality of removable portal means for exposing the gridlike network below portions of the substantially flat plate.

16. The portable decking form of claim 15, comprising in addition linking means connected to the gridlike network and situated in alignment with the removable portal means for connection to lifting means to permit the balanced lifting of the decking form from one vertical level to another.

17. The portable decking form of claim 1, wherein the gridlike network and the vertical girders of the second ground-engaging support means are fabricated of aluminum.

18. The portable decking form of claim 1, wherein the upper surface of the substantially flat plate is formed of a material which is nonadherent to freshly poured concrete.

* * * * *